US005344090A

United States Patent [19]

Nakai et al.

[11] Patent Number: 5,344,090

[45] Date of Patent: Sep. 6, 1994

[54] TURRET TYPE YARN WINDER

[75] Inventors: Shoji Nakai, Ibaraki; Shuichiro Iami, Toyonaka, both of Japan

[73] Assignee: Kamitsu Seisakusho Ltd., Hyogo, Japan

[21] Appl. No.: 52,342

[22] Filed: Apr. 22, 1993

Related U.S. Application Data

[62] Division of Ser. No. 689,950, May 22, 1991, Pat. No. 5,228,630.

[30] Foreign Application Priority Data

| | | | |
|---|---|---|---|
| Sep. 27, 1989 | [JP] | Japan | 1-249191 |
| Sep. 27, 1989 | [JP] | Japan | 1-249192 |
| Mar. 29, 1990 | [JP] | Japan | 2-32982[U] |
| Jun. 29, 1990 | [JP] | Japan | 2-170260 |
| Aug. 28, 1990 | [JP] | Japan | 2-89739[U] |

[51] Int. Cl.[5] ..... B65H 67/048

[52] U.S. Cl. ..... 242/18 A

[58] Field of Search ..... 242/18 A, 18 PW, 25 A, 242/64

[56] References Cited

U.S. PATENT DOCUMENTS

| | | | |
|---|---|---|---|
| 3,126,165 | 3/1964 | van Eijk | 242/18 A X |
| 3,490,707 | 1/1970 | Warshaw | 242/18 A |
| 3,856,222 | 12/1974 | Wiist | 242/18 A |
| 3,921,923 | 11/1975 | Kuno et al. | 242/18 A |
| 4,106,710 | 8/1978 | Schippers et al. | 242/18 A X |
| 4,138,069 | 2/1979 | Bonzo et al. | 242/18 A |
| 4,216,920 | 8/1980 | Tambara et al. | 242/18 A |
| 4,431,138 | 2/1984 | Schiminski et al. | 242/18 A |
| 4,917,319 | 4/1990 | Lenk | 242/18 A |
| 5,029,762 | 7/1991 | Behrens et al. | 242/18 A |

FOREIGN PATENT DOCUMENTS

| | | |
|---|---|---|
| 1040690 | 10/1958 | Fed. Rep. of Germany . |
| 0374536 | 11/1989 | Fed. Rep. of Germany . |
| 1117576 | 2/1956 | France . |
| 421174 | 12/1934 | United Kingdom . |
| 1270823 | 4/1972 | United Kingdom . |

*Primary Examiner*—Stanley N. Gilreath
*Attorney, Agent, or Firm*—Paul and Paul

[57] ABSTRACT

A turret type yarn winder comprising a first detecting means (32) for detecting the arrival of an empty bobbin at a yarn-transfer position (F) and outputting a signal, a second detecting means (46) for detecting the arrival of a traverse guide (5) at one turning point and outputting a signal, a third detecting means (47) for detecting the arrival of the traverse guide (5) at another turning point and outputting a signal and a pneumatic cylinder mechanism (42–45) for axially shifting a yarn traverse cam (4a) momentarily by a predetermined distance, whereby the traverse guide can be traversed while exceeding a yarn holding device (38) on the base end of a bobbin. The respective bobbin chucks (1a, 1b) are driven by a common motor via a respective clutch mechanism (50, 167); the clutch mechanism (50, 167) being selectively maintained at one phase of either a full engagement, half engagement, or disengagement during the path of an orbital motion.

6 Claims, 16 Drawing Sheets

| Fig. 16(a) |
| --- |
| Fig. 16(b) |

TURRET TYPE YARN WINDER

CROSS REFERENCE TO RELATED APPLICATIONS

This is a division of application Ser. No. 07/689,950, filed on May 22, 1991, now U.S. Pat. No. 5,228,630.

TECHNICAL FIELD

The present invention relates to a turret type yarn winder, in which a pair of chucks for holding bobbins are arranged on a turret disc coaxial by and symmetrical to each other, and a full bobbin and an empty bobbin held on the respective chucks are alternately exchanged by the rotation of the disc so that the winding operation can be carried out without interruption. Particularly, it relates to a winder of the above type in which a yarn is taken up onto the bobbin while being traversed by a yarn traverse mechanism, during which the turret disc is rotated so that one chuck holding a working bobbin on which the yarn is being wound is gradually distanced from the traverse mechanism secured in a fixed position.

BACKGROUND ART

In general, in the turret type yarn winder, when an exchange of a full bobbin with a fresh empty bobbin is made, a yarn now being taken up is removed from a traverse guide to be transferred out of the normal traverse range of the yarn traverse mechanism with the aid of an exclusive guide means, is wound on an empty bobbin while the yarn is held by a yarn holding means secured, for example, on a base portion of a bobbin chuck, and then is severed from the full bobbin.

Due to the structure of a turret type winder, in which a pair of bobbin chucks are driven by a single motor, both chucks are driven at the same rotational speed, and the motor speed is controlled so that the chuck rotational speed becomes slower in accordance with an increase of a diameter of a bobbin held on the chuck now performing a winding operation and a yarn continuously delivered at a constant speed can be taken up without excessive tension or slack. During the above-described bobbin exchange operation, the yarn taken up on a full bobbin of a larger diameter is transferred to an empty bobbin of a smaller diameter driven at the same rotational speed as that of the former, which means that the yarn take-up speed is sharply lowered. Therefore, in a transition period until a desired rotational speed of a motor has been attained, which speed is controlled to correspond to a smaller diameter of a bobbin on which a yarn is freshly wound, the yarn is liable to be slackened due to the lower rotational speed of a bobbin chuck holding the empty bobbin, whereby a smooth yarn transfer and winding operation are hindered. To avoid this drawback, according to the conventional turret type winder, a plurality of dancer rolls are provided on a yarn feeding path to absorb yarn slack caused by the disparity between a yarn feeding speed and a yarn winding speed on a bobbin (see Japanese Examined Patent Publication No. 48-31178).

As stated above, a winder using an exclusive guide for a yarn transfer, provided other than a yarn traverse guide, has drawbacks in that it must have a complicated mechanism for driving the exclusive guide, the motion of which becomes inaccurate because of a repeated yarn transfer and often breaks down, which increases the man/hour required for the maintenance thereof.

On the other hand, the mechanism for absorbing a yarn slack by a series of dancer rolls at the beginning of a yarn transfer causes the total size thereof to be enlarged, and it is difficult to obtain the predetermined removal of yarn slack due to the rotational resistance of the dancer roll itself, as well as the yarn friction.

DISCLOSURE OF THE INVENTION

A primary object of the present invention is to eliminate the above-mentioned drawbacks of the prior arts, and to provide a mechanism capable of transferring a yarn without the provision of an exclusive yarn transferring guide, while utilizing the conventional yarn traversing device used for the normal yarn winding.

A second object of the present invention is to provide a clutch mechanism for rotating the respective bobbin chucks so that the yarn transfer from a full bobbin and an empty bobbin can be smoothly carried out by modifying a torque transmitted to the bobbin chuck, without using a complicated and expensive control means, by the utilization of an orbital motion of a bobbin chuck which begins from the starting position via a full bobbin position where a full bobbin is removed and an empty bobbin is supplied, and resumes again the starting position.

The primary object of the present invention is attained by a turret type yarn winder in which a pair of bobbin chucks are arranged on a turret disc symmetrically with each other relative to a center of the turret disc and a continuous yarn winding operation is carried out by repeating the steps of: taking up a yarn on a bobbin carried by one of the bobbin chucks while subjecting the yarn to a traverse motion by a traverse guide; displacing an empty bobbin carried by the other bobbin chuck to a winding-start position through an orbital motion of the turret disc; and transferring the yarn on the full bobbin to a yarn end holding device provided at a base end portion of the empty bobbin, characterized in that the winder comprises a first detecting means for detecting the arrival of a bobbin chuck carrying an empty bobbin at a yarn-transfer position just before a winding-start position during the course of the orbital motion and outputting a signal, a second detecting means arranged in the vicinity of a turning point of the traverse motion of the traverse guide on the side of a tip end of the bobbin chuck for detecting the arrival of the traverse guide at the turning point and outputting a signal, a third detecting means arranged in the vicinity of another turning point of the traverse motion of the traverse guide on the side of a base end of the bobbin chuck for detecting the arrival of the traverse guide at the turning point and outputting a signal, and a yarn traverse cam shifting mechanism for axially shifting the yarn traverse cam in parallel to the bobbin chucks by a predetermined distance; whereby, during the yarn-transfer operation, the yarn traverse cam shifting mechanism is actuated by a first detecting signal from the second detecting means after the first detecting means has output a detecting signal so that the yarn traverse cam is shifted to cause the traverse guide to be displaced beyond the yarn end holding device on the base end portion of the bobbin, and thereafter, the yarn traverse cam shifting mechanism is again actuated by a first detecting signal from the third detecting means so that the yarn traverse cam is shifted to resume the original position.

Preferably, the yarn end holding device comprises an annular clamp member engageable with and disengageable from a friction member provided on the base end surface of the bobbin chuck, and means for displacing the annular clamp member away from the bobbin end surface at the predetermined phase of the orbital motion of the bobbin chuck.

Preferably, the annular member is provided with a plurality of hooks on the periphery thereof on the side in contact with the friction member.

Preferably, the yarn traverse cam shifting mechanism is a pneumatic cylinder but the cam is slidably mounted on a shaft.

Preferably, the engagement and disengagement between the annular member and the friction member are carried out in synchronism with the shifting of the yarn traverse cam.

Preferably, the engagement and disengagement between the annular member and the friction member are carried out by a cam mechanism arranged along a path of the orbital motion of the bobbin chucks.

A winder advantageously further comprises means for forming a bunch wind, which comprises a bunch lever provided with a hook portion for restraining a traverse motion of a yarn brought out of the normal traverse range by the shifting operation of the yarn traverse cam; said bunch lever being reversibly pivotable between an operative position and a waiting position and actuated synchronously with the shifting of the yarn traverse cam 4.

The second object of the present invention is attained by a turret type yarn winder comprising a turret disc driven to rotate about a center thereof by a first motor, a pair of bobbin chucks rotatably secured on the turret disc at positions symmetrical with each other relative to the center of the turret disc, a pair of spindles for carrying the respective bobbin chucks, and a second motor for commonly driving the spindles; a continuous yarn winding operation being carried out by circulating a bobbin carried by one of the bobbin chucks along a path of orbital motion starting from a winding-start position through a full bobbin position, a doffing section, a yarn-transfer position, and coming back again to the winding-start position, while a full bobbin is being doffed from the bobbin chuck and an empty bobbin is being doffed thereon in the doffing section, characterized in that, the winder further comprises a mechanical clutch mechanism for stepwisely adjusting a torque transmission from the second motor to the respective spindles, and means for actuating the clutch mechanism in accordance with the phase of the orbital motion of the bobbin, whereby the spindle carrying the full bobbin is driven by a torque smaller than that necessary for maintaining the normal winding tension.

Preferably, the clutch mechanism is selectively switched to any one of three states of a full engagement in which a torque from the motor is fully transmitted to the spindle, a half engagement in which part of the torque is transmitted to the spindle, and a non-engagement in which no torque is transmitted to the spindle.

Preferably, the clutch mechanism of the spindle carrying a bobbin is maintained in the full engagement state in the course of the orbital motion between the winding-start position and the full bobbin position, in the half engagement state between the full bobbin position and the doffing-start position, and in the non-engagement state between the doffing-start position and the doffing-end position, then again returns the full engagement state thereafter.

Preferably, the orbital motion of the bobbin chuck is interrupted at the yarn-transfer position so that the yarn transfer operation is correctly carried out.

Preferably, the first motor is a stepping motor and the second motor is a torque motor or a speed-variable motor.

Preferably, the turret disc is driven along the path of the orbital motion by the intermittent rotation of the motor from the doffing-start position to the doffing-end position, then by the continuous rotation thereof from the doffing-end position to the yarn-transfer position, and then stops at the yarn-transfer position for a predetermined period, and by the continuous rotation to the winding-start position.

BRIEF DESCRIPTION OF THE DRAWINGS

The present invention will be described in more detail below with reference to the drawings illustrating the preferable embodiments:

FIGS. 16(*a*) and 16(*b*) are time charts illustrating an operational sequence of the present invention.

BASIC STRUCTURE OF THE PRESENT INVENTION

The basic constition of the present invention will be described with reference to a turret type winder in which a yarn bobbin is displaced in a direction opposite to that of the orbital motion of a bobbin chuck, as the diameter of the bobbin increases.

Figure 1:
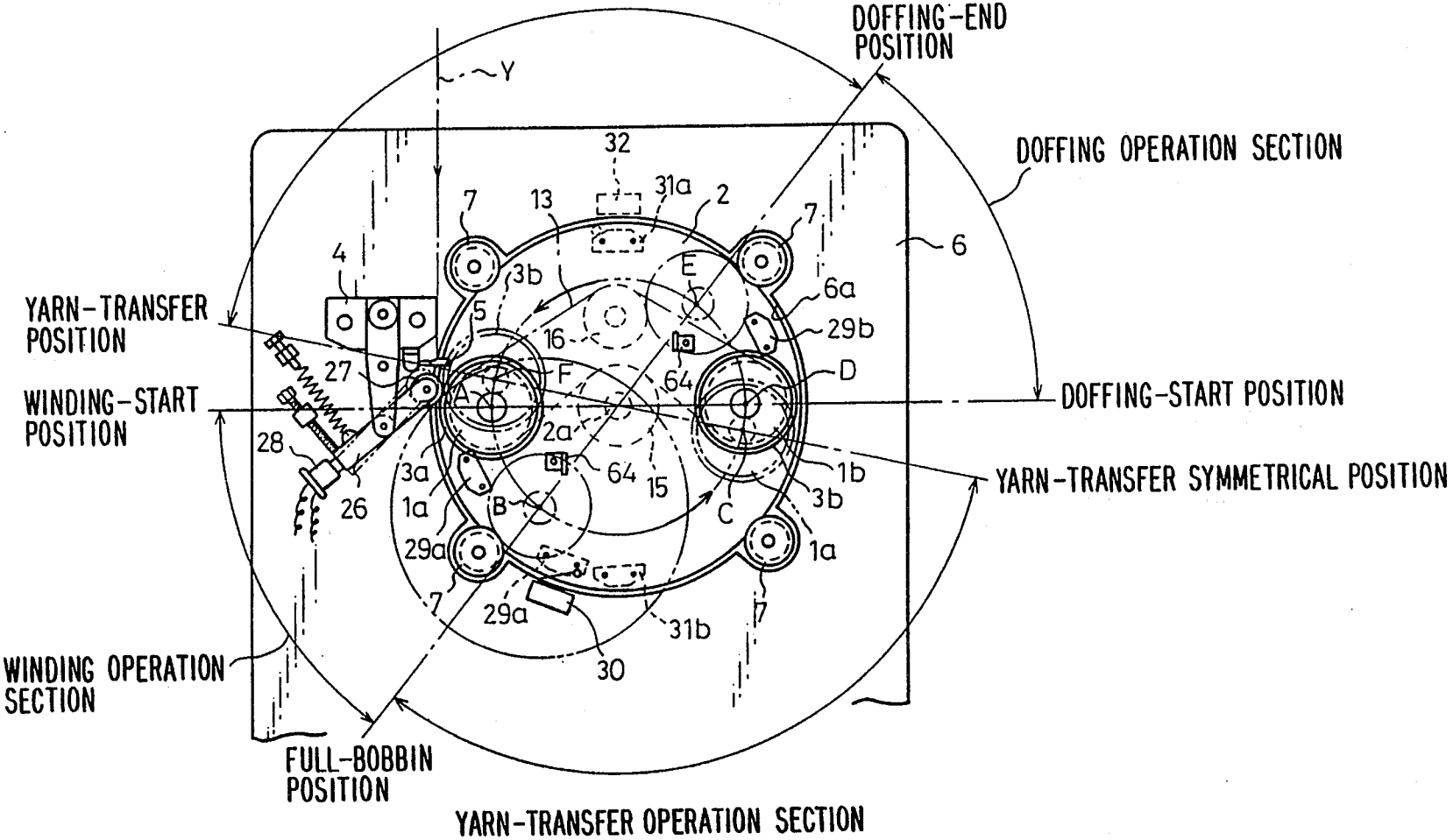
FIG. 1 is a front view illustrating the respective positions of bobbins held on bobbin chucks.

According to this yarn winder, as illustrated in FIG. 1, a pair of bobbin chucks 1*a*, 1*b* are provided at diametrically symmetrical positions on a circle while held in rotation about their own axes, respectively. Regarding one bobbin chuck 1*a*, a bobbin 3*a* held thereon is first positioned at a winding-start position A and subjected to an orbital motion in the counterclockwise direction the diameter thereof increases due to the yarn wound thereon; and reaches a full-bobbin position B when the bobbin has become full. When it has passed a doffing-start position D (via a yarn-transfer symmetrical position C) symmetrical to the winding-start position A, the full bobbin 3a is replaced by a fresh empty bobbin 3b. The fresh bobbin 3b is subjected to the orbital motion toward the winding-start position A via a doffing-end position E symmetrical to the full bobbin position B. Regarding the other bobbin chuck 1b, a bobbin held thereon, i.e., a fresh empty bobbin 3b just mounted in place of a full bobbin 3a while passing the doffing-start position D reaches a yarn-transfer position F via the doffing-end position E, and thereafter, runs on a path of the orbital motion while passing the winding-start position A, the full bobbin position B a yarn-transfer symmetrical position C, and the doffing-start position D. Thus, a yarn is continuously taken up without an interruption of yarn delivery by repeating the switching of both bobbin chucks.

Here, the doffing-start position D means a position where the doffing operation is possible on the bobbin chuck after it has passed this position, and similarly the doffing-end position E means a position where the doffing operation should be completed by the time the bobbin chuck has reached this position. Therefore, the actual doffing operation can be carried out at any position included in doffing section defined between the doffing-start position D and the doffing-end position E.

Figure 2:
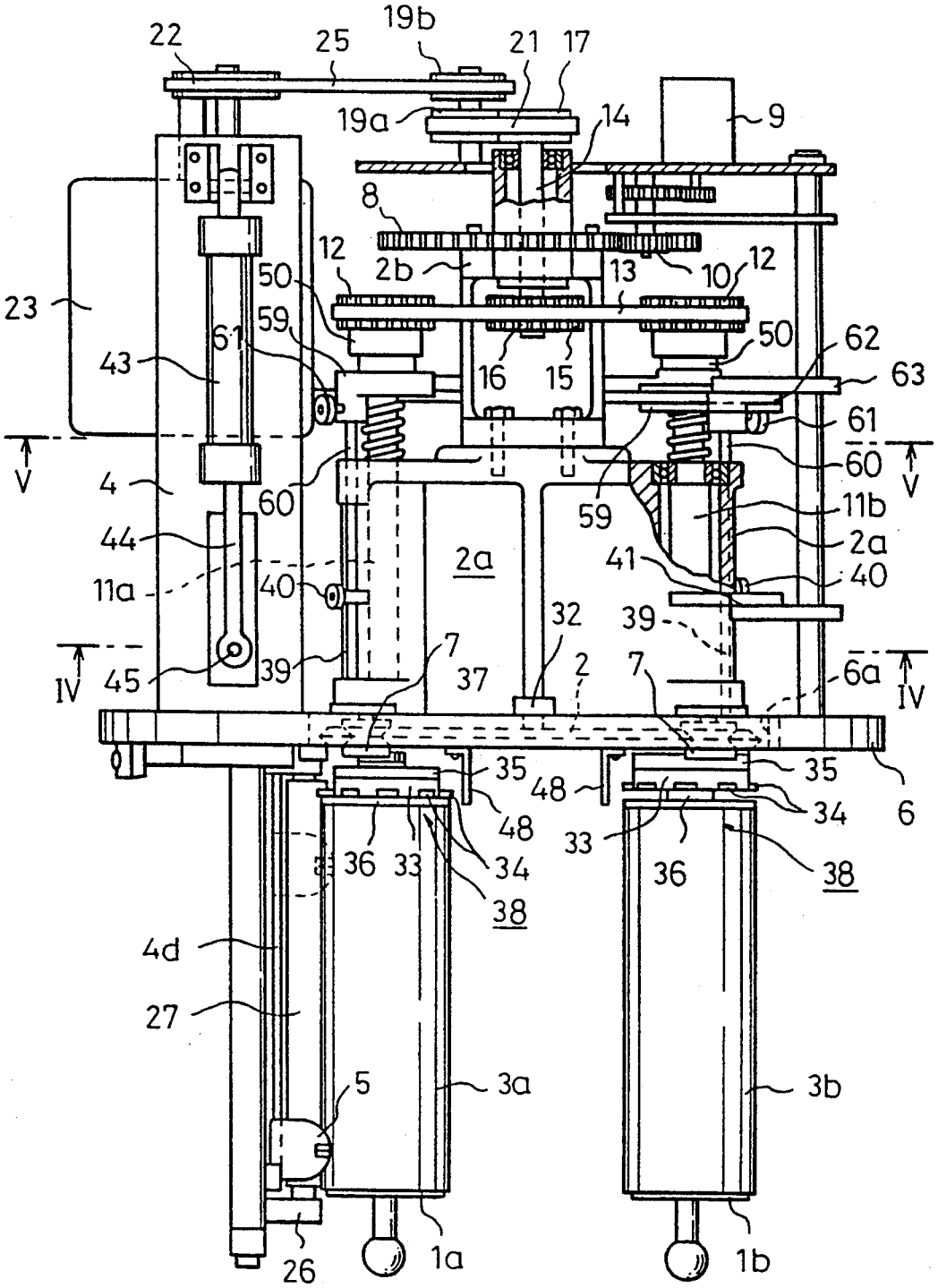
FIG. 2 is plan view of the same.

As illustrated in FIGS. 1 and 2, a pair of bobbin chucks 1a, 1b are rotationally arranged on a turret disc 2. One bobbin chuck 1a is positioned at the winding-start position A confronting a yarn traverse device 4 secured at a fixed position. A yarn Y is wound on the bobbin 3a held on the bobbin chuck 1a while traversed by a yarn traverse guide 5, as shown in FIG. 1.

The turret disc 2 is rotatably accommodated in an aperture provided in a fixed machine frame 6 while held at the periphery thereof by rolls 7, and driven in the arrowed direction as shown in FIG. 1 by a stepping motor 9 through an intermesh between a driving gear 10 associated with the stepping motor 9 and a large wheel 8 fixedly secured on the rear part of bearing members 2a and a support member 2b of the disc 2. Spindles 11a, 11b of the respective bobbin chucks 1a, 1b support the bearing members 2a while passing there through and carry a pulley 12, respectively, at the free end thereof. A pulley 15 is fixedly mounted on a shaft 14 held on the support member 2b while passing through the center of the large wheel 8, and driven, together with pulleys 12, 12 secured at the ends of the respective spindle shafts, by a timing belt 13 via tension pulley 16. A pulley 17 secured at an other end of the shaft 14 and a pulley 19a of an intermediate shaft 18 are driven by a timing belt 21 via a tension pulley 20. An intermediate pulley 19b and a pulley 22 secured at an end of a traverse cam 4a of the yarn traverse device 4 is driven by a driving motor 23 via a tension pulley 24 and a timing belt 25. That is, the respective spindles 11a, 11b of the bobbin chucks 1a, 1b and the traverse cam 4a are driven by the motor 23 while maintaining a predetermined relationship between the rotational speeds thereof. In this regard, the motor 23 is either adapted to be speed-controlled automatically so that the take-up speed is kept constant in accordance with the displacement of dancer rollers due to the variation of a tension of yarn Y delivered continuously at a constant speed, or manufactured as a torque motor by which a substantially constant tension is ensured due to the principle thereof.

Accordingly, the spindles 11a, 11b, and thus the bobbin chucks 1a, 1b are simultaneously subjected to the same directional orbital motion and rotated in the same direction on their own axes by the motor 23 through an associated mechanism.

The yarn traverse device 4 is arranged behind the machine frame 6 and has a known yarn traverse cam 4a with a pair of grooves 4b across one another. By the rotation of the cam 4a, a traverse guide 5 fixed on a rod 4d connected to a sliding guide 4c engaged with the grooves 4b is subjected to a traverse motion while confronting the bobbin chuck 1a occupying the winding-start position A shown in FIG. 1 due to a reciprocated motion of the rod 4d in the lengthwise direction along the machine frame 6.

The bobbin 3a on the bobbin chuck 1a at the winding-start position A is rotated about its own axis while in contact with a pressure roller 27 and winds the yarn Y thereon. As the winding of yarn progresses and the diameter of the bobbin increases, the pressure roller 27 is swung counterclockwise in FIG. 1 to cause a swingable member 26 to move to a position shown by a chain line, whereby the free end of the member 26 is distanced from a proximity switch 28 arranged in the vicinity thereof. This displacement is detected by the proximity switch 28 and the stepping motor 9 for the orbital motion of the turret disc 2 is started by the detected signal, whereby the turret disc 2 is subjected to the orbital motion in the counterclockwise direction. When the pressure roller 27 resumes the original position and the swingable member 26 again occupies a position shown by a solid line to be detectable by the proximity switch 28, the stepping motor 9 is made to stop but the yarn winding operation continues at that position. At stated above, the bobbin chuck 1a is intermittently subjected to a part of the orbital motion while continuing the yarn winding in accordance with the repletion of a start and stop of the stepping motor 9. When the diameter of the yarn layers on the bobbin has reached a predetermined value and the bobbin chuck 1a has occupied the full bobbin position B, a projection 29a on the turret disc 2 is in contact with a limit switch 30 on the machine frame 6. According to a detecting signal issued from the limit switch 30, the stepping motor 9 is shifted to a continuous operation phase for bobbin-switching so that the turret disc 2 is continuously subjected to the orbital motion to cause an empty bobbin 3b carried on the other bobbin chuck 1b to be displaced to the yarn-transfer position F. At this position, another projection 31b on the turret disc 2 is in contact with another limit switch 32, whereby the stepping motor 9 stops so that the full bobbin 3a and the empty bobbin 3b temporarily rest at the positions C and F, respectively, whereby the yarn-transfer operation can be correctly carried out. After the yarn-transfer operation has been completed, the stepping motor 9 is restarted and the orbital motion continues to quickly bring the empty bobbin 3b to the winding-start position A and the full bobbin 3a to the doffing-start position D, respectively. Thus the bobbin switching operation is completed. According to the repetition of the bobbin switching operations, the continuous yarn winding can be carried out without the interruption of the yarn delivery while alternately using the respective two bobbin chucks.

As the means for transferring the yarn during the bobbin switching operation, a yarn holding device 38 is provided at the base end of the respective bobbin chucks 1*a*, 1*b*, by a slide ring 35 integral with an annular clamp member 33 having a plurality of hooks 34 at a periphery thereof, which ring 35 is rotatable together with the bobbin chuck and slidable in the axial direction by a bias of a spring 37 so that the side surface of the respective hook 34 is always pressed onto a friction member 36 on the end surface of the bobbin chuck to clamp the yarn Y between the annular clamp member 33 and the end surface of the bobbin chuck.

An actuating lever 39 is arranged to pass through the turret disc 2, while one end thereof is fixed onto the slide ring 35 and the other end is supported by the bearing member 2*a* to be slidable therethrough. A cam follower 40 is mounted in the middle portion of the actuating lever 39 so that the annular clamp member 33 is distanced from the end surface of the bobbin chuck when the cam follower 40 is engaged with an arcuate plate cam 41 arranged along a path of the cam follower 40 accompanied with the orbital motion of the turret disc 2 and pushes back the actuating lever 39 against the biasing force of the spring 37.

Figure 9:
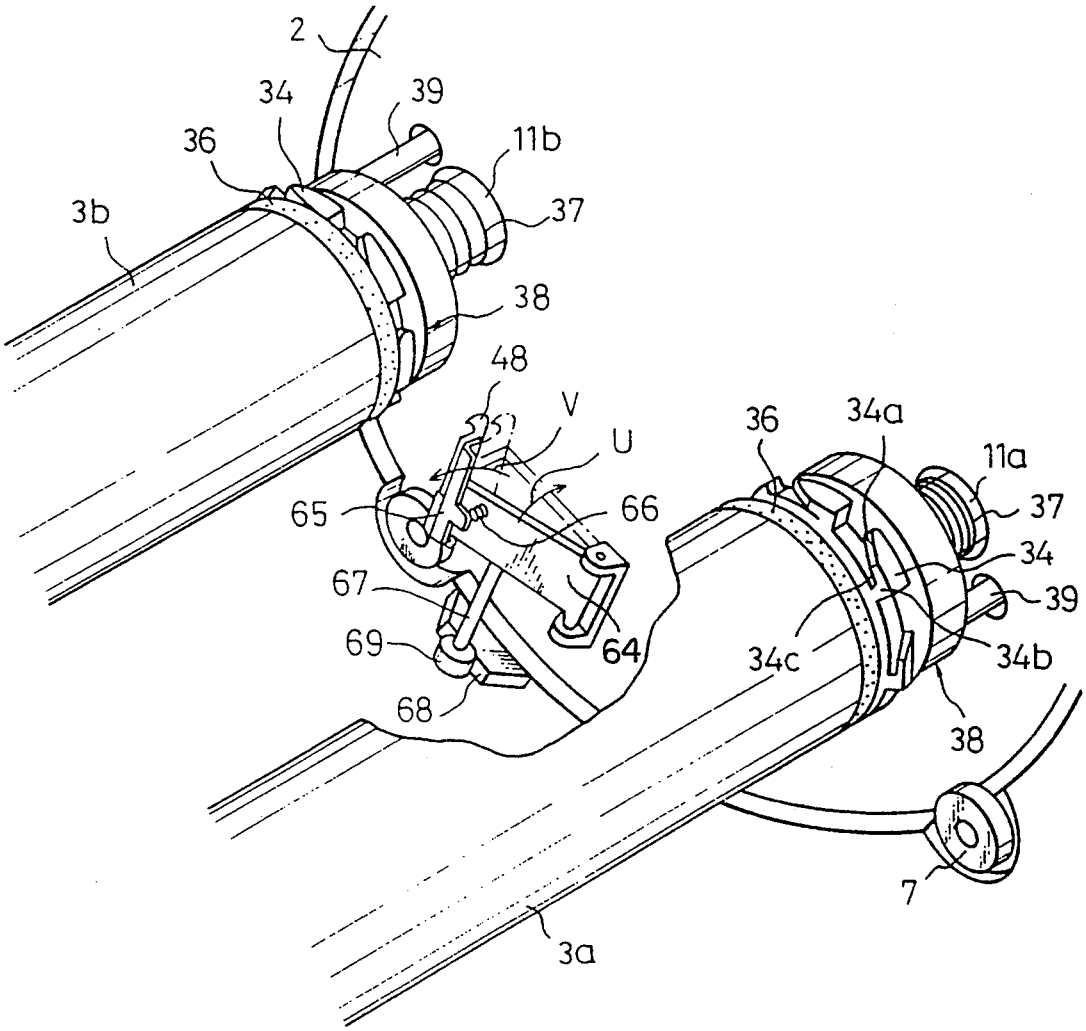
FIG. 9 is a perspective view of one embodiment of a yarn cutting device.

As shown on an enlarged scale in FIG. 9, a side surface of the hook 34 confronting the friction member 36 is formed by a slant 34*a* for easing the yarn catching and a flat clamp surface 34*b* following the same. Further, a slit 34*c* extends beneath the slant 34*a* to the middle areas of the clamp surface 34*b*.

Figure 7A:
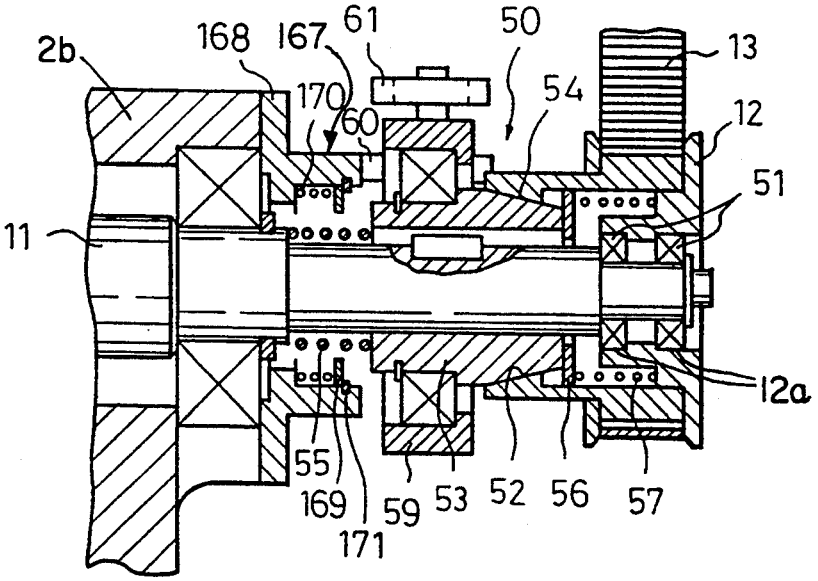
FIGS. 7(*a*), 7(*b*) and 7(*c*) are sectional views of a clutch mechanism, respectively, illustrating the operational states.
Figure 7B:
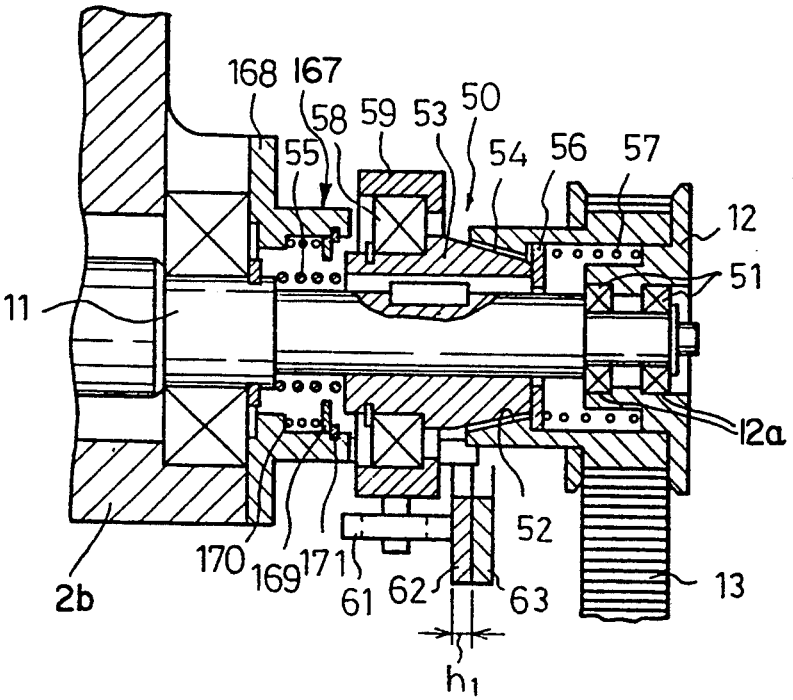
Figure 7C:
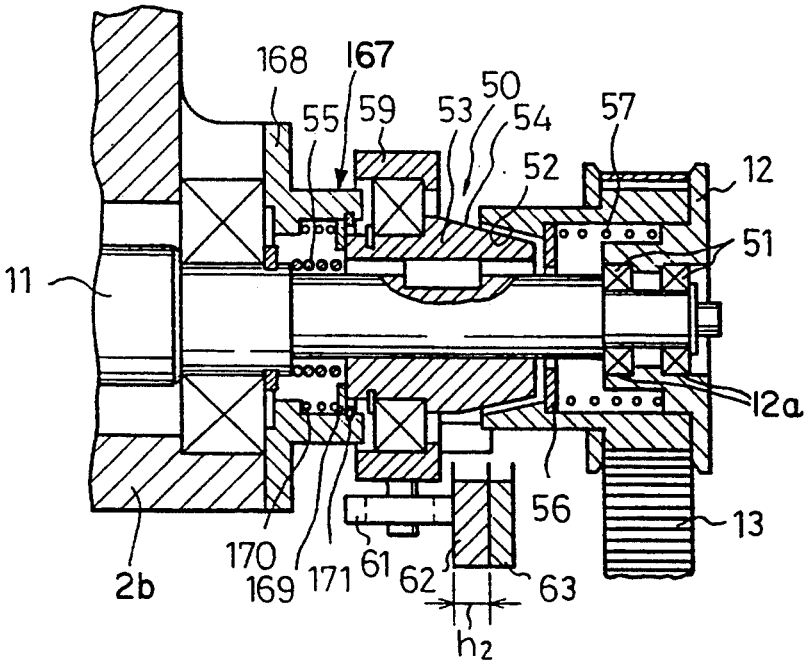

The respective spindle 11*a*, 11*b* are driven in the associated manner by the con, non motor 23, and a clutch mechanism 50 is arranged between the respective spindle and the motor. Preferably, this clutch mechanism is a friction type clutch in which a transmitted torque is adjustable in a stepwise manner. One example of a structure thereof is shown in FIGS. 7(*a*)–7(*c*), in which a pulley 12 is rotatably mounted on the end of the respective spindle 11 through two bearings 51 accommodated in a hollow boss 12*a*. The inner periphery of the end portion of the boss 12*a* is formed as a conical inner surface 52. On the other hand, a clutch member 53 is secured, for example, by a key to the spindle 11 to be not only rotatable therewith but also slidable in the axial direction, which has a conical outer surface 54 always biased toward the conical inner surface 52 by a main spring 55, to be frictionally engageable with the conical inner surface 52. In the interior of the boss 12*a*, a clutch disc 56 is arranged while confronting the clutch member 53 and is biased thereto by an additional spring 57 weaker than the main spring 55.

An annular member 59 encircles the clutch member 53 while supported by a bearing 58, to be relatively rotatable with the clutch member 53. The annular member 59 is also displaceable only in the axial direction together with the clutch member 53 along a small shaft 60 fixed onto the support member 2*a*. A cam follower 61 is fixed on the annular member 59, which is engageable with an arcuate plate cam 62 arranged along the path of the orbital motion of the spindle 11 caused by the rotation of the turret disc 2. The annular member 59 causes the clutch member 53 to be displaced in the axial direction by the action of the plate cam 62 and the cam follower 61.

A brake 167 is secured coaxially with the clutch mechanism 50 and a disc-like brake member 169 is loosely fitted while inhibited the rotation within a brake case 168 fixed on the support member 2*b*. The brake member 169 is also displaceable in the axial direction of the spindle 11 and confronts the clutch member 53 so that one side surface of the brake member 169 is frictionally engageable with the end surface of the clutch member 53. Further the brake member 169 is biased toward the ring 171 by a compression spring 170.

Figure 5:
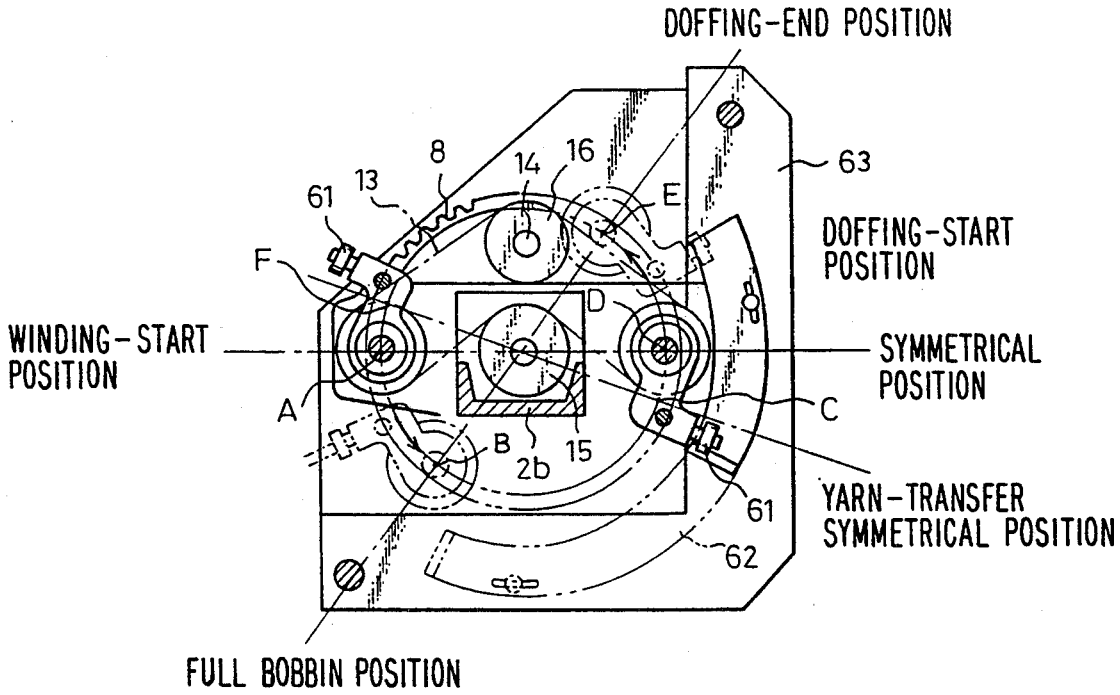
FIG. 5 is a section taken along lines V—V of FIG. 2.
Figure 6:
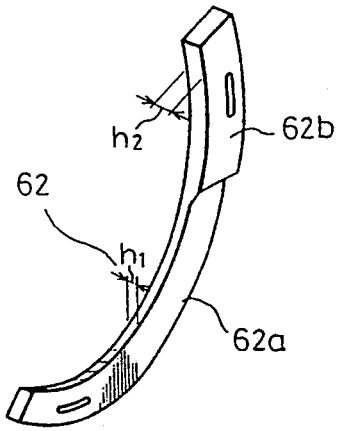
FIG. 6 is a perspective view of an arcuate plate cam.

As shown in FIGS. 5 and 6, the arcuate plate cam 62 has an arc length with which the cam follower 61 is continuously engageable in the section of the orbital motion from an certain position following the full bobbin position B, via the yarn-transfer symmetrical position C opposite to the yarn-transfer position F, to the doffing-end position E where the full bobbin is replaced by the empty bobbin, and is mounted on a frame panel 62 in the position-adjustable manner. The plate cam 62 has a thinner width of $h_1$ in the area 62*a* corresponding to one from the certain position following the full bobbin position B to the doffing-start position D compared to a width of $h_2$ in the area 62*b* corresponding to from the doffing-start position D to the doffing-end position E.

The yarn traverse cam 4*a* of the yarn traverse device 4 is adapted to be displaceable in the axial direction relative to the driving shaft through a mounting means such as a spline connection or a key connection. An pneumatic cylinder mechanism is provided for the axial displacement of the cam 4*a* and an actuating lever 45 is fixed on the free end of a piston rod 44 thereof. The actuating lever 45 is engaged at the lower end thereof into an annular recess 42 formed on the end of the cam 4*a*. According to this structure, the yarn traverse cam 4 is made to shift in the axial direction by a predetermined distance when the pneumatic cylinder mechanism 43 is actuated.

Figure 3:
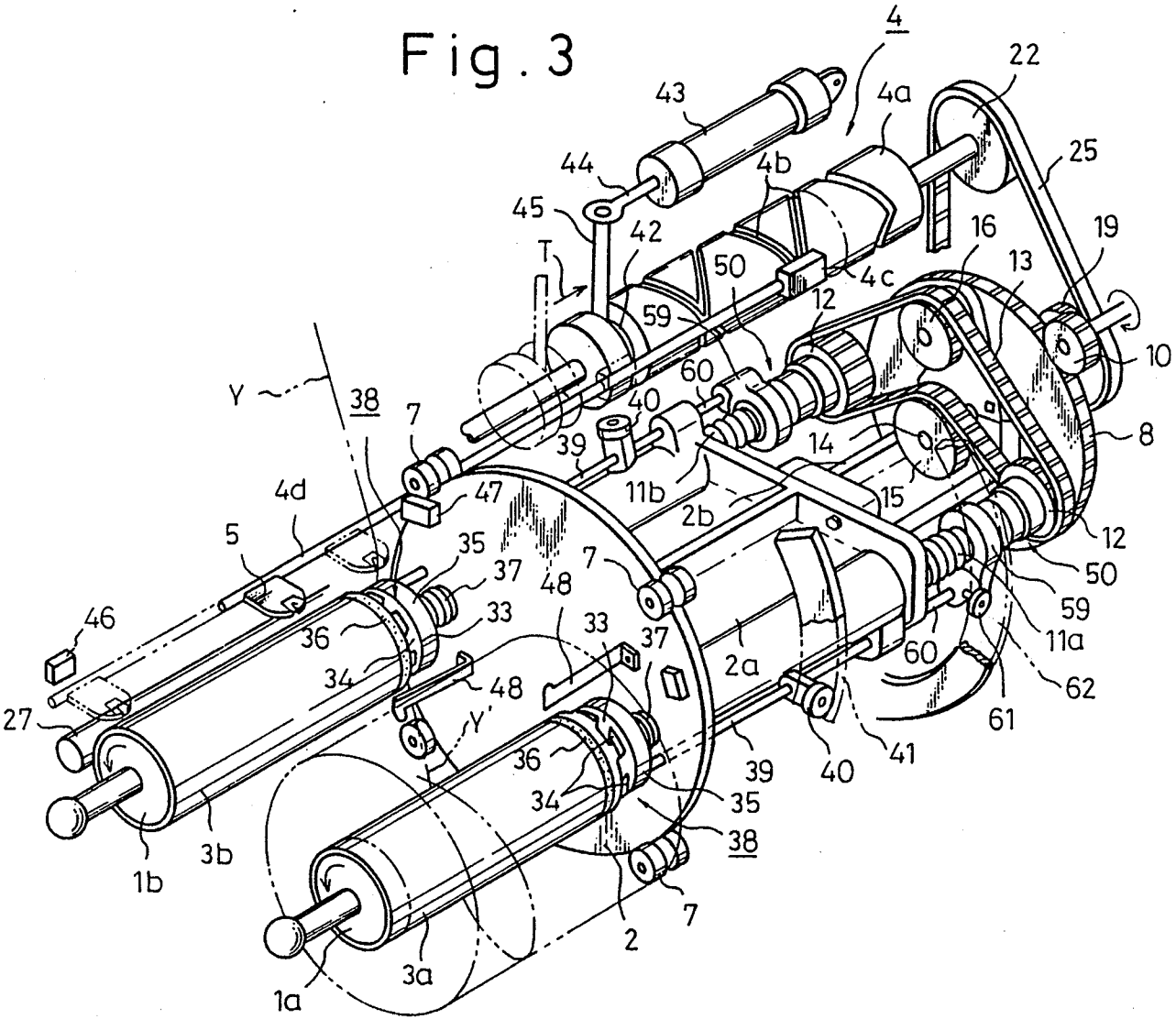
FIG. 3 is a perspective view of a main part of the same.
Figure 4:
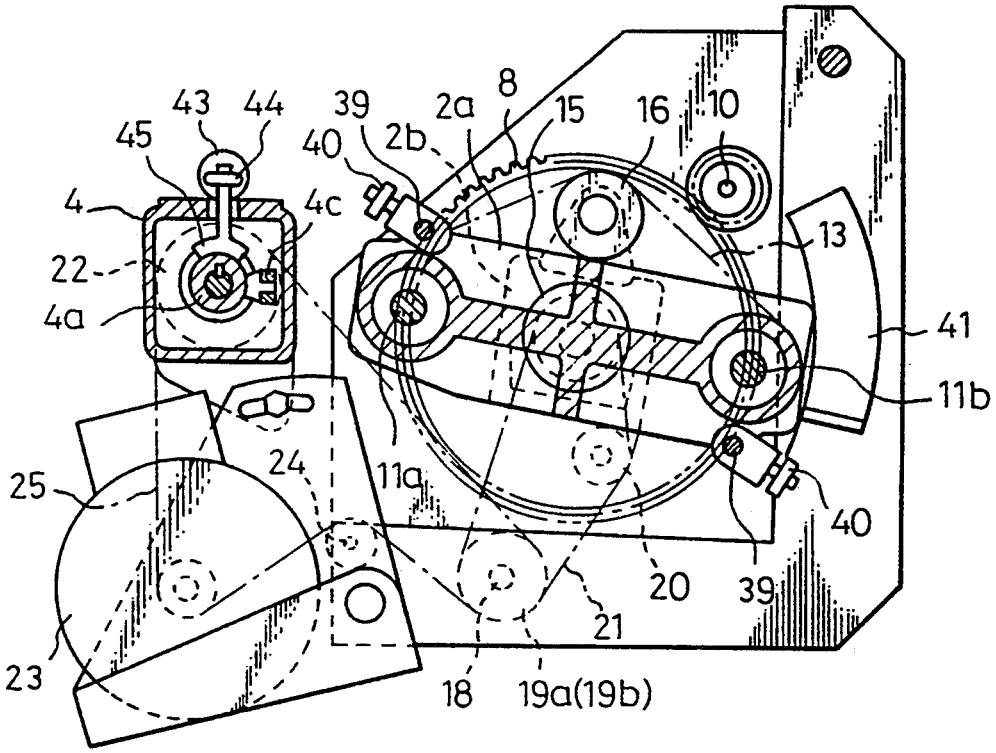
FIG. 4 is a section taken along lines IV—IV of FIG. 2.

This shift of the cam 4*a* is carried out as a part of the yarn transfer operation between the bobbins. As shown in FIG. 3, when the empty bobbin 3*b* replaced by the full bobbin 3*a* has reached the yarn-transfer position F, a limit switch 32 (a first detecting means) is first actuated to stop the stepping motor 9 for subjecting the turret disc 2 to the orbital motion, whereby the orbital motion of both the bobbins 3*a*, 3*b* is temporarily stopped.

Under this state, when the traverse guide 5 in the traverse motion reaches the end of the empty bobbin 3*b* and changes direction at the turning point, a limit switch 46 (a second detecting means) is actuated to issue a detection signal. The pneumatic cylinder mechanism 43 is actuated by this signal to displace the yarn traverse cam 4*a* in the arrowed direction from a position shown by chain line in FIG. 2 at which the normal yarn traverse motion for yarn winding is carried out to another position shown by a solid line. Thereby, the traverse guide 5 can traverse beyond the normal traverse range to reach the yarn holding device 38 provided outside of the base end of the empty bobbin 3*b*, so that the yarn Y is brought to the yarn holding device 38. As the empty bobbin 3*b* rotates on its own axis, the yarn Y is caught by the hooks 34 at the periphery of the annular clamp member 33. A yarn portion caught by the hooks 35 is clamped, as a starting end of the winding, between the clamp membership 33 and the friction member 36 on the end surface of the bobbin chuck and then raised in the rotational direction of the bobbin in the area other than the normal winding position. At this time, a yarn portion Y′ extending from the full bobbin 3*a* to the empty bobbin 3*b* is suitably tensioned so that it is pressed onto an cutting edge 48 arranged in a yarn path and severed. Thus the yarn transfer from the full bobbin 3*a* to the empty bobbin 3*b* is completed.

When the direction of the traverse guide 5 is changed at the base end turning point, a limit switch 47 (a third detecting means) is actuated to issue a detection signal by which the pneumatic cylinder mechanism 43 moves in the reverse direction and causes the yarn traverse cam 4*a* to resume the original position, whereby the traverse guide 5 is subjected to the normal traverse motion so that the yarn winding on the empty bobbin 3*b* is restarted.

Figure 8:
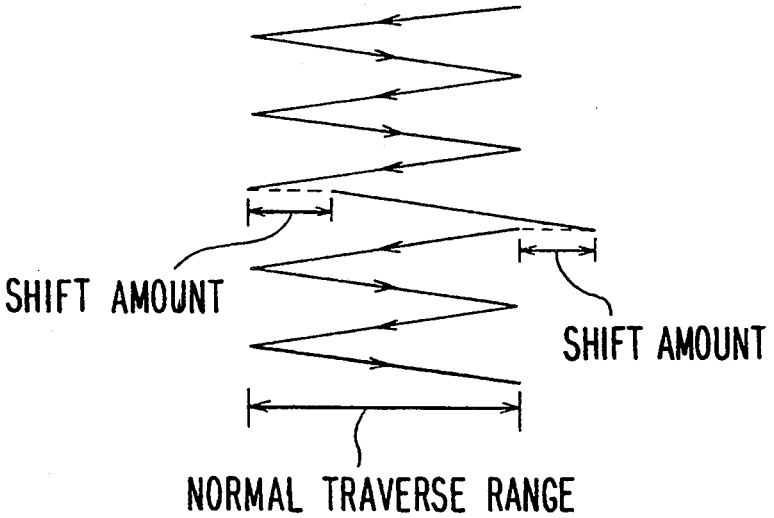
FIG. 8 is one example of a path of a yarn traverse guide caused by a shift of a traverse cam.

FIG. 8 diagrammatically illustrates the change of a traverse range of the traverse guide 5 according to the axial shift of the yarn traverse cam 4*a*.

The empty bobbin is promptly transferred to the winding-start position A by a continuous rotation of the stepping motor 9 caused by the continuous input of a predetermined number of pulses from a timer or a counter. The generation of these pulses is started when the limit switch 46 (the second detecting means) has been actuated by a first traverse motion after the return of the traverse am to the normal position, and hereafter, the yarn winding at a normal speed begins. Alternatively, the continuous rotation of the stepping motor may be caused by the utilization of an on/off motion of the limit switch 32 while adjusting an engagement angle between the limit switch 32 and the projections 31*a*, 31*b*.

On the other hand, the full bobbin is also transferred to the doffing-start position E by this continuous rotation of the stepping motor 9. In this course, conical surface 54 of the clutch member 53 is distanced from the conical surface 52 of the hollow boss 12*a*, as shown in FIG. 7(*c*), by the engagement of the cam follower 61 with the arcuate plate cam plate 62, whereby the clutch 50 is made inoperative. Further, since the clutch member 53 is resiliently engaged with the brake member 169, the rotation of the spindle 11 is braked so that an uncontrolled rotation of the free yarn end is avoided.

The full bobbin 3*a* replaced by the empty bobbin 3*b* is gradually rotated along a path of the orbital motion by the stepwise movement of the stepping motor 9 as the diameter of the bobbin 3*b* increases, and reaches the doffing-start position D as shown in FIG. 1. At this point, the annular clamp member 33 is distanced from the end surface of the bobbin by the contact of the cam follower 40 with the arcuate cam 41, so that the clamped yarn end is released. Since the full bobbin 3*a* still remains in the braked condition at this time, the operator can remove the full bobbin 3*a* from the bobbin chuck 1*a* to replace with a fresh empty bobbin, to preparate for the next operation.

In this embodiment, for controlling the shift operation of the yarn traverse cam 4*a*, limit switches 46, 47 are arranged as second and third detecting means, in the vicinity of the turning points of the traverse guide 5 at which the traverse guide changes direction. Note, a disc may be provided in place of the limit switches, and is associated with the rotation of the yarn traverse cam 4*a* to rotate once per each reciprocation of the traverse motion. The position of the traverse guide 5 can be indirectly determined by detecting the angular position of the disc through two limit switches.

Next, a function of the clutch mechanism for an automatic control and modification of the rotational speeds of the respective bobbins 3*a*, 3*b*, and for avoiding slack in the delivered yarn when the yarn is transferred from the full bobbin to the empty bobbin, will be explained below.

As shown in FIG. 5, the cam follower 61 of the spindle 11 subjected to the orbital motion in the counterclockwise direction is outside of the operating area of the plate cam 62 until the empty bobbin 3*b* starting from the winding-start position A and passing the full bobbin position B has reached a point midway between the latter and the yarn-transfer symmetrical position C. Therefore, the respective members of the clutch mechanism 50 occupy positions shown in FIG. 7(*a*), whereby the pulley 12 and the spindle 11 are completely engaged with each other, i.e., a driving torque derived from the pulley 12 is fully transmitted to the spindle 11.

When the bobbin 3*b* is further rotated from the midway point, the cam follower 61 is brought into contact with a section 62*a* of the plate cam 62 having a thickness of $h_1$, then the cam follower 61 is shifted along the spindle axis by this thickness and the conical surface of the clutch member 53 and that of the hollow boss 12*a* in the pulley 12 are disengaged from each other, whereby the clutch disc 56 is pressed onto the end surface of the clutch member 53. Accordingly, until the bobbin chuck carrying the empty bobbin has reached the winding-start position, the bobbin chuck carrying the full bobbin is driven with a transmitted torque smaller than that necessary for maintaining the normal yarn winding tension, while generating slip due to the incomplete clutch engagement relationship between the spindle 11 and the pulley 12.

When the bobbin 3*b* has reached the doffing-start position D by the further orbital motion, the cam follower 61 begins to be brought into contact with a section 62*b* of the plate cam 62 having a thickness of $h_2$, whereby the clutch member 53 is further shifted along the spindle axis, as shown in FIG. 7(*c*). Under these circumstances, the torque transmission is completely interrupted and the spindle 11 is also braked to stop the rotation thereof. This braked state continues until the bobbin chuck passes the doffing-end position E at which the cam follower 61 is disengaged from the operating area of the plate cam 62.

Thereafter, the clutch resumes the full engagement state whereby the newly mounted empty bobbin is subjected to the quick orbital motion toward the yarn-transfer position F, as stated before, while rotating on its own axis at a high speed.

Where a speed-variable motor is used as a motor 23 for driving the spindle, which speed is adjusted by a signal corresponding to the detected yarn tension, a balance point deviates to the acceleration side in accordance with a decrease of yarn tension caused by the lowering of a rotation torque of the full bobbin due to the abovesaid half-clutch state. Therefore the peripheral speed of the empty bobbin increases to become equal to that of the full bobbin, or larger than the latter, so that yarn slack is prevented before the yarn is taken up by the empty bobbin. In addition, a suitable tension is applied thereby on a yarn length bridging both bobbins, and thus the yarn severing operation can be correctly carried out.

In another case where a torque motor having a constant velocity-torque characteristic is used as a motor 23 for driving the spindle so that a yarn winding tension is maintained at a constant value, the rotational speed of the motor increases because a load applied to the motor is lowered due to the decrease of a torque transmitted by the clutch mechanism on the full bobbin side, whereby the rotation of the empty bobbin is sufficiently accelerated before reaching the yarn-transfer position F, as in the former case.

FIG. 9 illustrates another embodiment of a mechanism for severing a yarn length bridging both bobbins.

An arm 64 is pivoted at a base end on the periphery of the turret disc 2, while biased by a spring in the direction of arrow U. At the tip end of the arm 64 are secured a yarn cutting edge 48 and a lever 65 in parallel thereto and pivoted at an end thereof. The lever 65 is always biased in the direction of arrow V by means of a coil spring 66. A cam follower 69 is secured on the tip end of a rod 67 projected from a midportion of the arm 64 and engaged with a cam piece 68 fixed on the from 6 to pivot the arm.

When the bobbin chuck rotates during its orbital motion to the yarn-transfer position, the arm 64 stands up to occupy an operative position shown in solid line due to the engagement of the cam follower 69 with the cam piece 68 and the yarn cutting edge 48 occupies a position on which the bridge yarn is crossed. During the yarn-transfer operation, first the bridge yarn Y' connected with the full bobbin and held by the hook 34 is brought into contact with the lever 65 and pushed thereby toward the tip end of the bobbin chuck 1*a* carrying the full bobbin so that it does not fall down from the end surface of the full bobbin. Thereafter, as the tension gradually increases, the bridge yarn causes the lever 65 to rotate against the force of the spring 66 and finally touches the yarn cutting edge 48 to be severed.

Improvement of Yarn Holding Means

Figure 10:
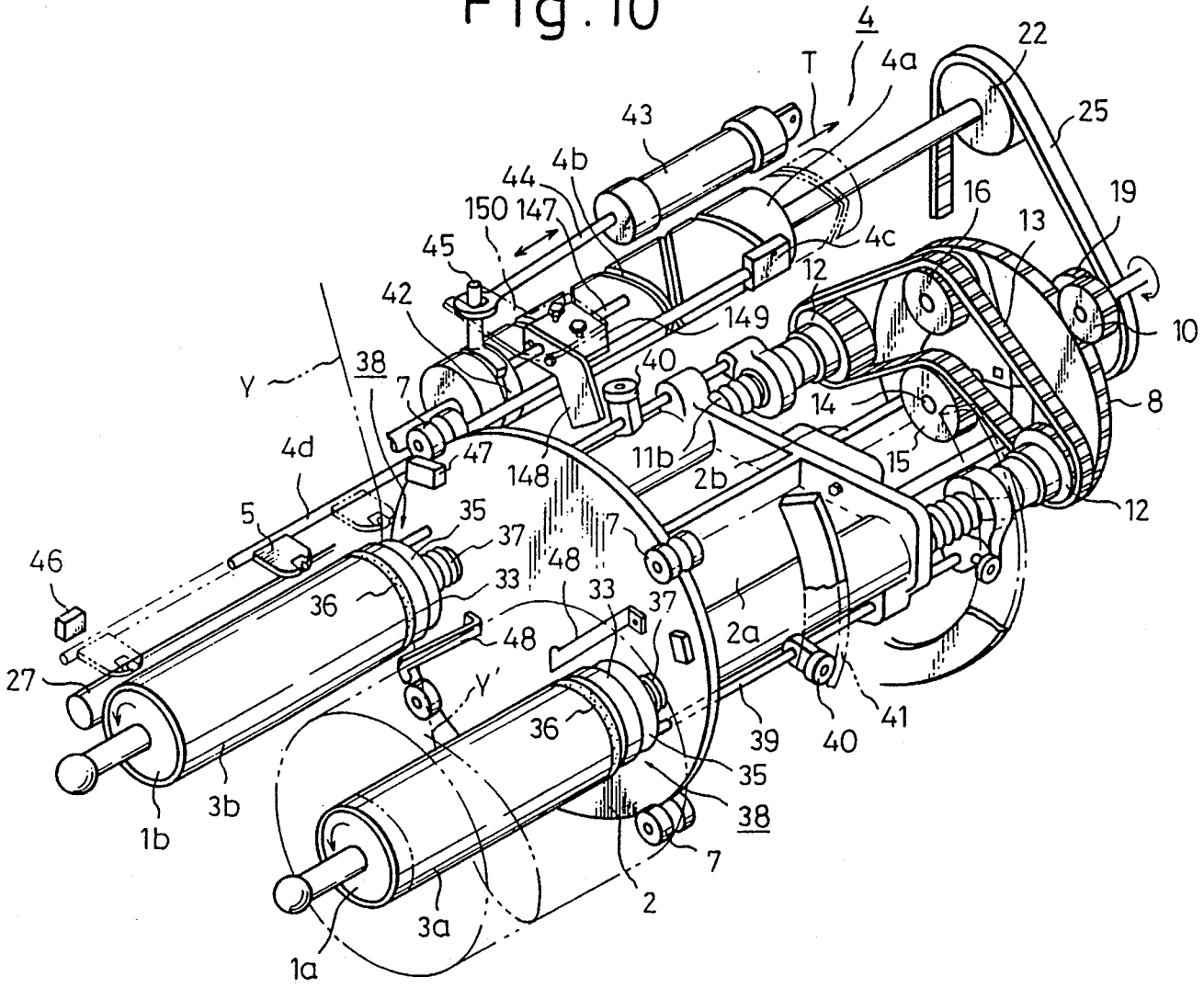
FIG. 10 is a perspective view of a yarn winder provided with an improved means for holding a yarn end according to the present invention.
Figure 11:
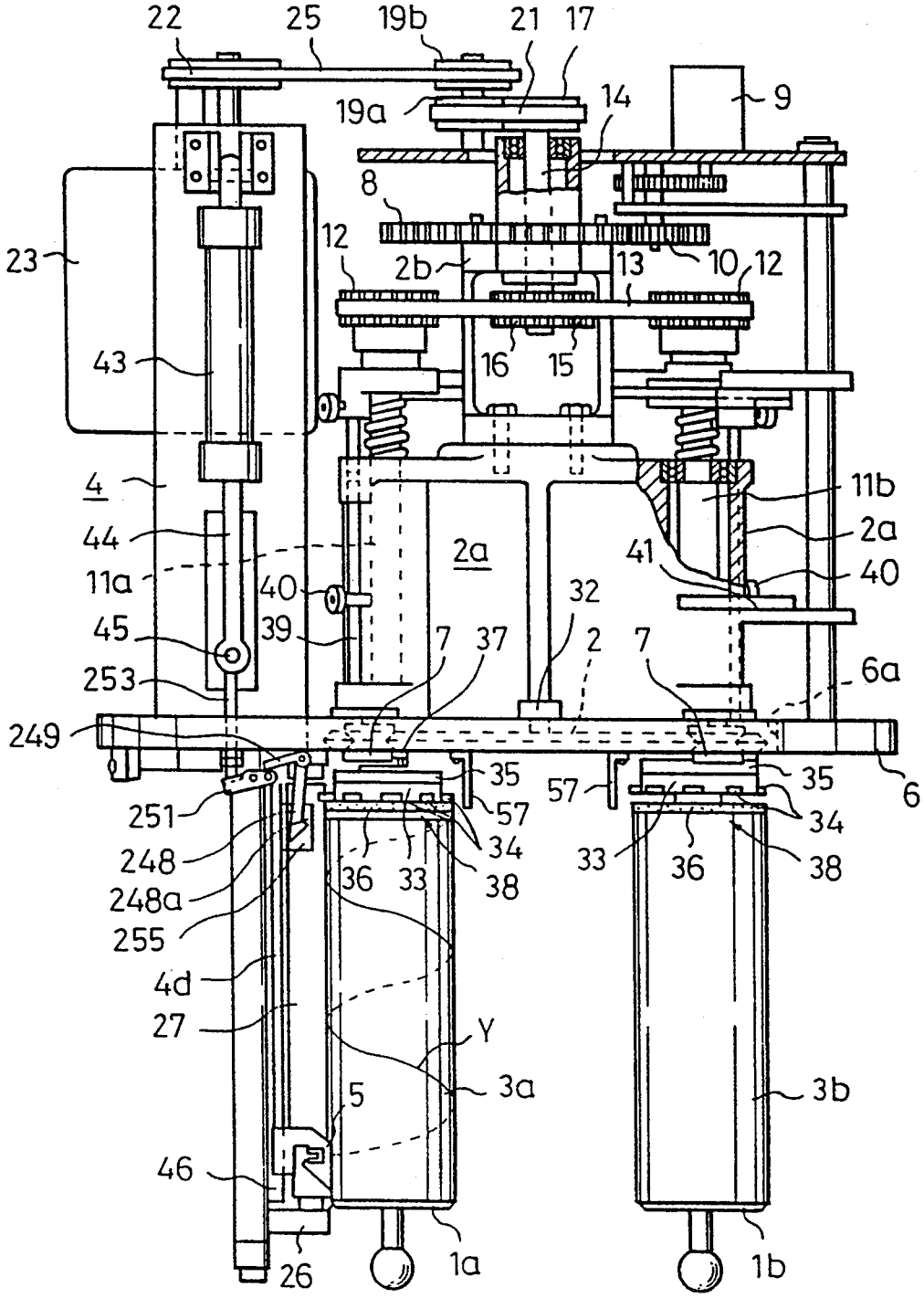
FIG. 11 is a plan view of a yarn winder provided with a bunch winding mechanism according to the present invention.

An improvement of the abovesaid basic structure of means for holding a yarn end during the yarn-transfer operation is illustrated in FIG. 10.

According to the basic structure of a yarn holding device 38, an annular clamp member 33 and a friction member 36 each provided at an end of the bobbin chuck are pressed against each other by a spring 37 and a yarn is pushed into a V-shaped gap between both the members 33 and 36 when the yarn is to be clamped on the end of an empty bobbin during the yarn-transfer operation. However, the operation of this structure is rather unreliable because it relies exclusively on the yarn winding tension. The illustrated embodiment aims to achieve a reliable clamp of the yarn end.

In the drawings, the same reference numerals are used for designating parts corresponding to those of the basic structure, for clarifying the relationships therebetween, and in the following description only the difference from the basic structure will be explained.

As shown in FIG. 10, a guide rod 147 is supported by a bracket (not shown) in parallel to the operative direction of a yarn traverse guide 5, and a slide member 149 carrying a contact piece 148 is slidably mounted thereon. The slide member 149 is connected, via an L-shaped plate 150 shown in chain line, with the upper end of an actuating lever 45 carried on the tip end of a piston rod 44 of a pneumatic cylinder mechanism 43. According to this structure, the contact piece 148 is reciprocated along with the slide member 149 in accordance with the extending/retracting stroke of the piston rod 44 when the yarn traverse cam 4*a* is shifted during the yarn-transfer operation.

The contact piece 148 is secured at a position engageable with the cam follower 40 of the bobbin chuck 1*a* or 1*b* occupying the yarn-transfer position F just before the completion of the retracting stroke of the piston rod 44 and pushes the cam follower 40 in the righthand direction in FIG. 10 to force the annular clamp member 33 away from the friction member 36 via the actuating lever 39, against the compression spring 37.

That is, when the pneumatic cylinder 43 is operated to shift the yarn traverse cam 4*a* to a righthand position shown by a chain line, the slide member 149 also slides in the righthand direction on the guide rod 147 in association therewith so that the contact piece 148 pushes the cam follower 40 to operate the actuating lever 39. Therefore a gap is formed between the annular clamp member 33 and the friction member 36, and the yarn Y carried, out of the normal yarn traverse range, close to the base end of the bobbin chuck can easily enter this gap. At the same time, the contact piece 148 disengages from the cam follower 40 and the annular clamp member 33 is pushed back to the original position by the force of the compression spring 37, so that the yarn is firmly clamped between the annular member 33 and the friction member 36.

According to this embodiment, since the gap is always formed between the annular clamp member 33 and the friction member 36, a complicated structure such as the hooks 34 of the annular clamp member of the basic structure as shown in FIG. 3 or 9 is unnecessary.

Mechanism for Forming Bunch Wind

An embodiment illustrated in FIGS. 11 through 14 is that in which a mechanism is added to the aforesaid basic structure, suitable for forming bunch wind of a predetermined number at an end of the empty bobbin during the yarn-transfer operation.

In a winder of the basic structure, a formation of a bunch wind is difficult during the yarn-transfer operation, because the yarn is always subjected to a traverse motion while the bobbin chuck is driven.

As disclosed in Japanese Unexamined Patent Publication No. 52-40635, means for forming a bunch wind in the prior art has the respective motors for separately driving a yarn transverse cam and a bobbin chuck, and only the motor for driving the yarn traverse cam is temporarily made to stop at the beginning stage of yarn winding on an empty bobbin so that a straight bunch wind is formed on the end of the empty bobbin. However, this mechanism needs an expensive control device such as a computer for synchronizing the rotation of the yarn traverse cam with that of a spindle carrying the bobbin chuck, whereby the total cost of the winder is increased.

Alternatively, a bunch lever with a hook for preventing a yarn from a traverse motion regardless of the rotation of a yarn traverse cam and a motion of a traverse guide is provided on a bobbin chuck, which is displaced to the operative position if necessary, where the yarn is restrained from the traverse motion and forms the straight bunch wind on the bobbin before the yarn is released therefrom, and subjected to the winding operation under the normal traverse motion. This device has a advantage that the rotational synchronization is easily obtained between the yarn traverse cam and the bobbin chuck, through a simple mechanism, but needs an exclusive drive source and a complicated mechanism for displacing the bunch lever between an operative position and a non-operative position at the desired moment.

An object of the third embodiment according to the present invention is to solve the abovesaid problems in the prior art and provide a simple mechanism by the utilization of a pneumatic cylinder originally used for shifting yarn traverse cam during the yarn transfer operation, as a drive source for actuating the bunch lever.

In FIGS. 11 through 14, similar reference numerals are used for designating similar parts illustrated in the preceding embodiments, so that the relationship therebetween is clarified. Accordingly, overlapping explanations are omitted and only the difference therebetween is described below:

In front of the frame 6 through which the connecting rod 4*d* of the yarn traverse device 4, a shaft 246 is rotatably supported by an upper bracket 247 (FIG. 14), and the bunch lever 48 having a hook portion 248*a* for preventing a traverse motion of a yarn Y is fixed at a lower end of the shaft 247 to be rotatable in the horizontal plane together with the shaft 247. The hook portion 248*a* is positioned beneath a path of the yarn traverse guide 5 exceeding the normal traverse range. Further, at the upper end of the shaft 247 is fixed a lever 249 which rotatably biases the bunch lever 248 by a spring 250 in the direction indicated by an arrow X in FIG. 13, so that the bunch lever 248 restrains the yarn Y.

An intermediate lever 251 is supported on the upper bracket 246 at a midportion thereof by a pin 251*c* and is engaged with the side of the lever 249 via a small roller 251*a* secured at one end of the lever 251. A tip end of a push rod 253 passing through a guide hole 252 provided on the frame 6 is brought into contact with a vertical surface 251*b* at the other end of the intermediate lever 251. The push rod 253 is arranged in line with the piston rod 44 of the pneumatic cylinder mechanism 43. When the piston rod is retracted, as shown by a solid line in FIG. 13, the push rod 253 is displaced backward by a bias force of the spring 250 acting on the lever 249 until a double nut 254 screwed with a thread portion 253*a* in a tip end area of the rod 253 is in contact with the edge of the guide hole 252. At that time, the bunch lever 248 is rotated counterclockwise, as shown by a solid line in FIG. 13, together with the shaft 247 to occupy an operative position at which a traverse motion of the yarn Y is prevented. When the piston rod 44 is in an extended condition, the push rod 44 is pushed out by a tip end of the piston rod 44 and the lever 249 is rotated clockwise against the bias force of the spring 250 through the intermediate lever 251 so that the bunch lever 248 together with the shaft 247 occupies a waiting position, as show by a dotted line, at which the bunch lever does not interferes with a yarn path.

An additional plate 255 is fixed on the back surface of a beam 256 provided with a rail for guiding the connecting rod 4*d* of the yarn traverse device 4. The lower edge of the plate 255 is positioned beneath the bunch lever 248 so that the yarn Y can be easily released from the hook portion 248*a* when the bunch lever 248 is rotated to occupy the waiting position while holding the yarn Y at the hook portion 248*a*.

Figure 12:
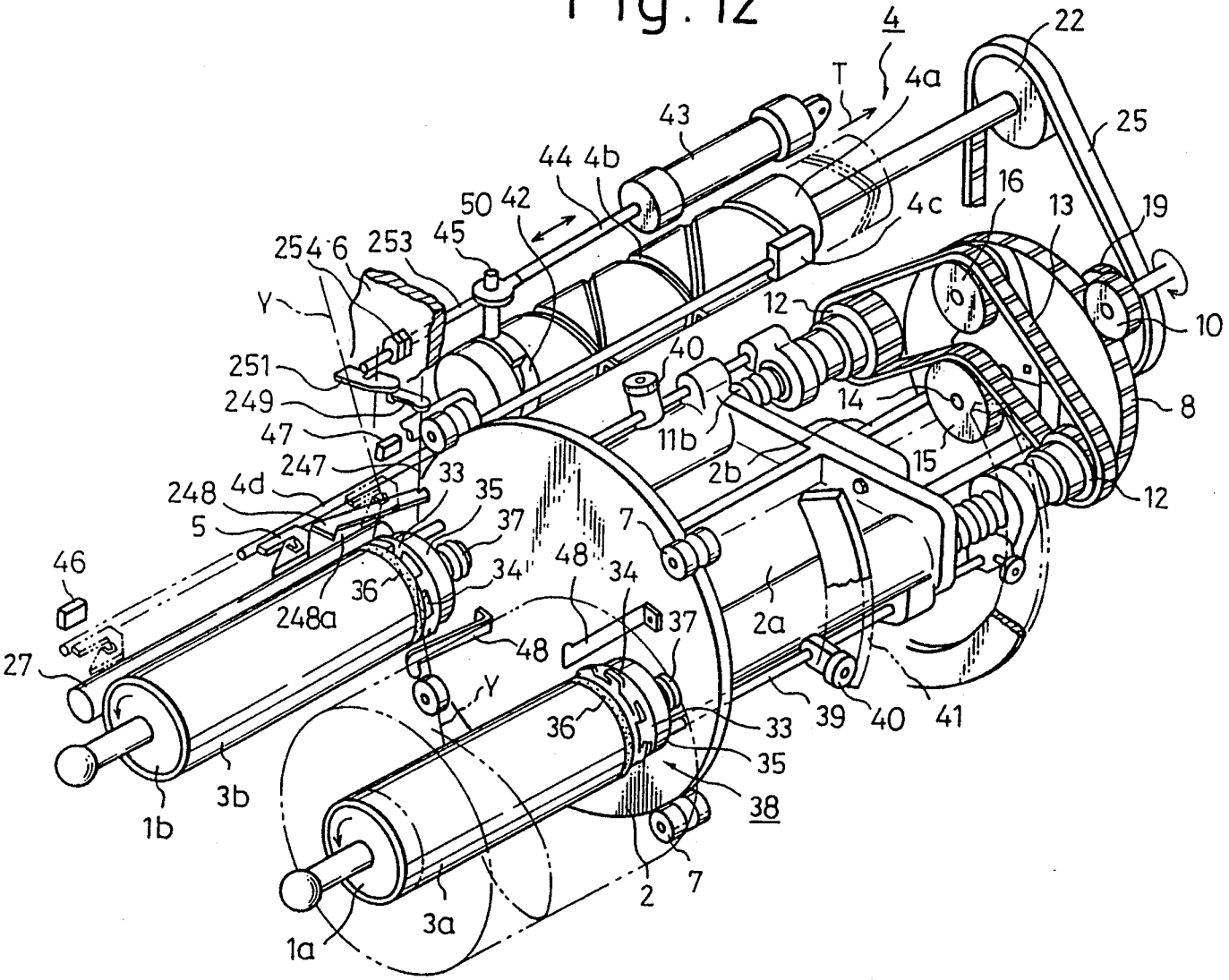
FIG. 12 is a perspective view illustrating a main part of the same.

When the pneumatic cylinder 43 is operated during the yarn transfer operation, the piston rod 44 is retracted to shift the yarn traverse cam 4*a* to the position shown by a dotted line in FIG. 12, whereby the yarn is clamped between the annular clamp member 33 and the friction member 36 on the bobbin end, and the bridge yarn Y' is severed by the yarn cutting edge 48.

Figure 13:
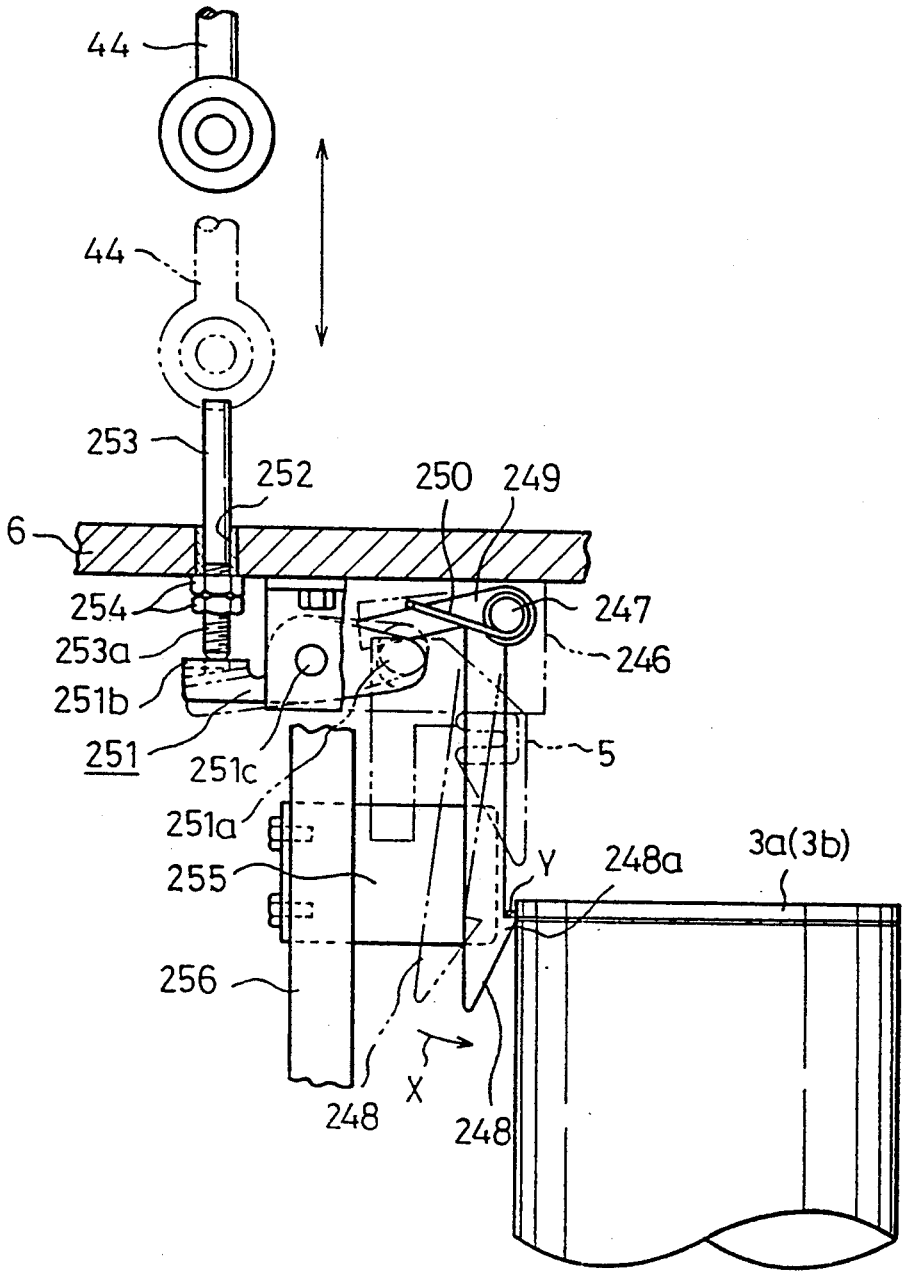
FIG. 13 is a plan view of a device for actuating the bunch winding operation of the same.
Figure 14:
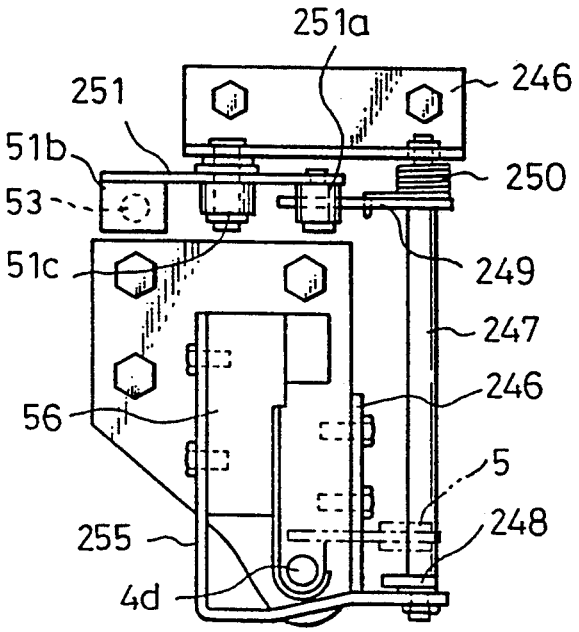
FIG. 14 is a front view of FIG. 13.

As the piston rod 44 is retracted, the push rod 253 is released from the pressure imparted by the piston rod 44 and retreats from a non-illustrated projected position to a position shown by solid line in FIG. 13. Therefore, a free rotation of the intermediate lever 251 is allowed and the shaft 247 integral with the lever 249 is rotated by a bias force of the spring 250 to displace the bunch lever 248 so that the hook portion 248*a* occupies an operative position beneath the traverse path of the yarn Y. As a result, the yarn Y in traverse motion while accompanied by the traverse guide 5 is caught by the hook portion 248*a* of the bunch lever 248 and released from the traverse motion while the traverse guide 5 repeats the traverse motion, so that the bunch wind is formed at a predetermined position close to the base end of the bobbin.

When the traverse guide 5 is turned at the base end of the bobbin, the limit switch 47, i.e., the third detecting means, is actuated to switch-on the timer, and maintains this state until a predetermined number of bunch windings are formed.

After the predetermined time has elapsed, the timer is switched off and a flow route of a solenoid valve (not shown) for supplying compressed air to the pneumatic cylinder 43 is changed to another route so that the piston rod 44 is projected, whereby the push rod 253 is pushed by the piston rod 44 to rotate the bunch lever 248 toward the waiting position as shown by a chain line in FIG. 13. As a result, the yarn Y is released from the hook portion 248*a*, and the traverse guide 5 resumes the proper traverse position so that the normal yarn winding can be carried out.

Control Circuit and Time Chart for Operation Sequence

Figure 15:
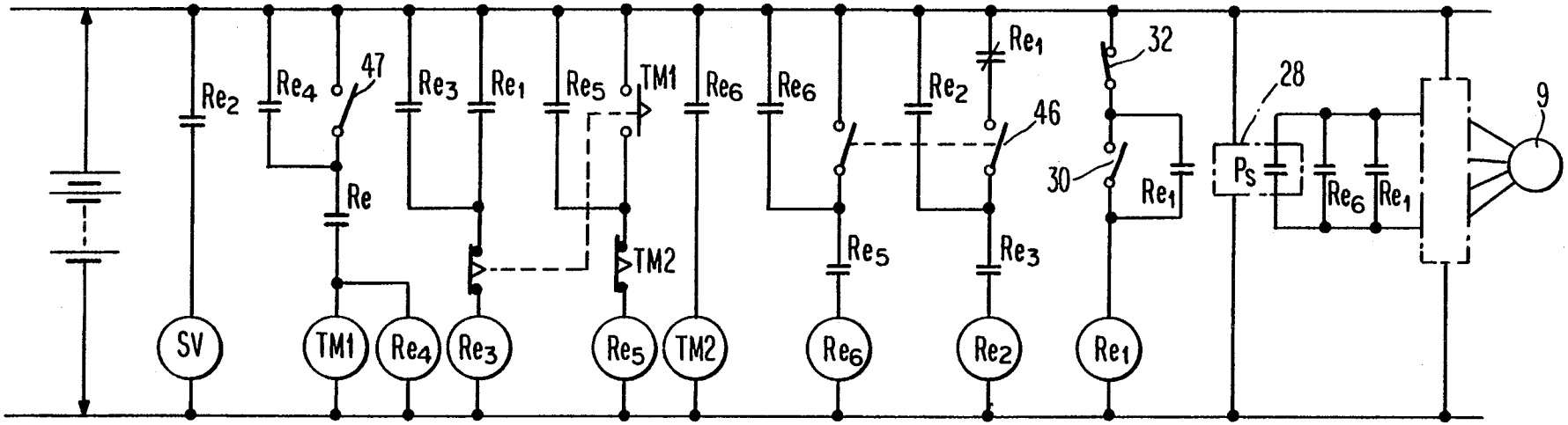
FIG. 15 is an electric circuit for the operational control of the yarn winder according to the present invention.

An operation sequence of a turret type winder according to the present invention stated above can be controlled, for example, by an electric circuit illustrated in FIG. 15, as described below.

1. When a spindle of a bobbin chuck carrying an empty bobbin has reached a doffing-end position E after passing through a doffing section, a limit switch 30 is switched-on to energize a relay $Re_1$. Then a contact $Re_1$ is closed to continuously rotate a stepping motor 9 to cause an orbital motion. When the spindle reaches a yarn-transfer position F, a limit switch 32 is switched off to de-energize the relay $Re_1$, which causes the stepping motor 9 to stop. Even though the relay $Re_1$ is de-energized, a relay $Re_3$ is still energized by a self-hold.

2. At a yarn-transfer position F, when a limit switch 46 arranged at a turning point of the traverse motion in the tip end area of a bobbin is actuated by the traverse guide 5, a relay $Re_2$ connected in series with a contact $Re_3$ in a closed state is energized and kept in this state by a self-hold. As a result, a solenoid valve SV is energized to shift the yarn traverse cam 4*a* in the axial direction.

3. When a limit switch 47 is actuated by the traverse guide after a yarn traverse cam 4*a* has been shifted, a timer $TM_1$ connected in series with a closed contact $Re_3$ is energized and starts a counting operation. The limit switch 47 goes from the closed state to an open state after a very short period, but, the power supply to the timer $TM_1$ is maintained by a self-hold of a relay $Re_4$ until a counting time is completed.

4. When a contact $TM_1$ is closed after the count of the timer $TM_1$ is completed, a relay $Re_5$ is energized and simultaneously, the relay $Re_3$ is de-energized. Due to the de-energization of the relay $Re_3$, the relay $Re_2$ is also de-energized to interrupt the power supply to the solenoid valve SV so that the yarn traverse cam 4*a* is shifted to the normal position. In this connection, the timer $TM_1$ is reset by the de-energization of the relay $Re_3$.

5. When the yarn traverse cam resumes the normal position and the limit switch 46 is actuated by the traverse guide, a relay $Re_6$ connected in series with the closed contact $Re_5$ is energized and maintained in this state by a self-hold, whereby the stepping motor 9 starts a continuous rotation. A timer $TM_2$ starts a count by the energization of the relay $Re_6$ and opens a contact $TM_2$ when that time has passed. As a result, the relay $Re_5$ is de-energized to stop the stepping motor 9.

The continuous drive of the stepping motor 9 lasts for a predetermined period set in the timer $TM_2$. Accordingly, if this period is properly selected, the spindle can travel from the yarn-transfer position F to the winding-start position A and stop at the latter position.

Figures 16, 16A:
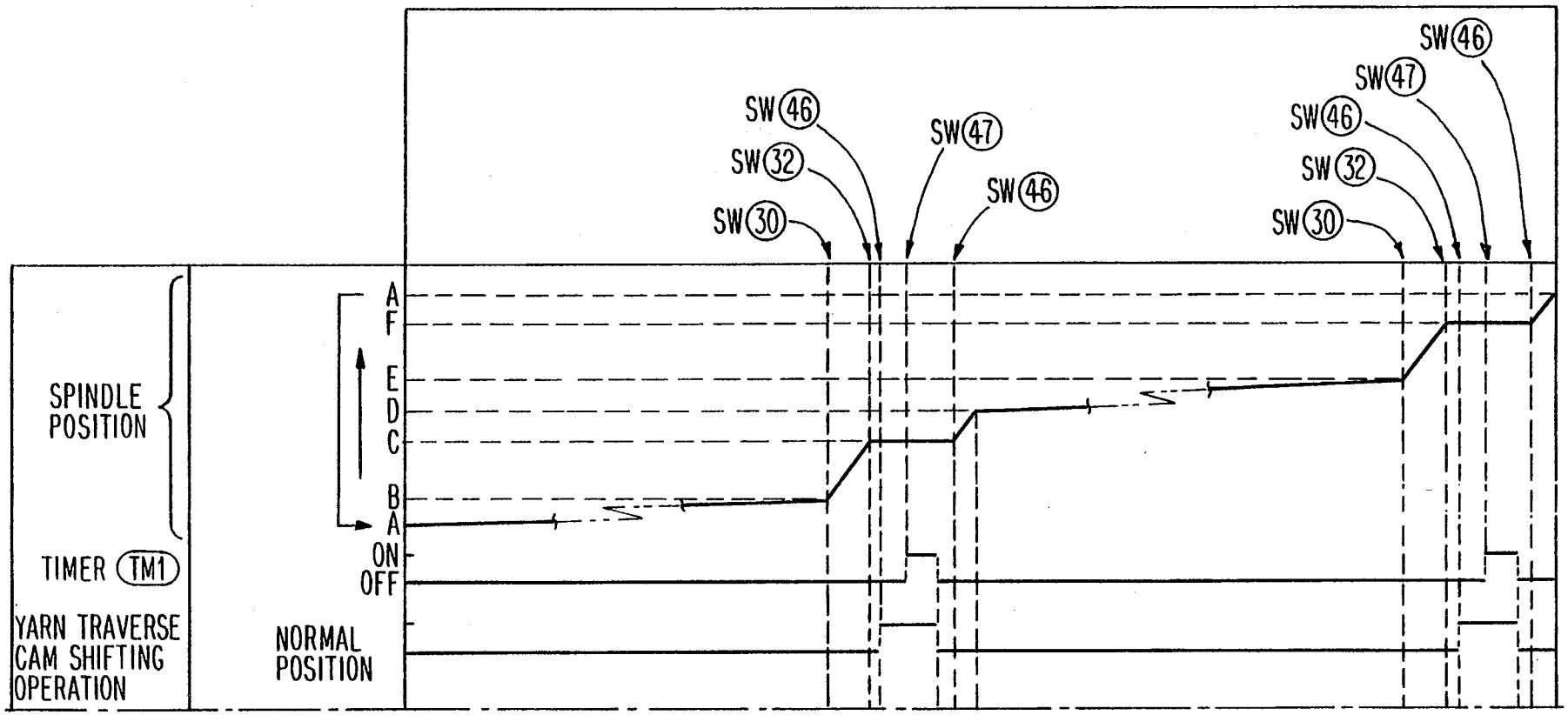
FIG. 16 is a chart showing the relationship of the time charts shown in FIGS. 16(*a*) and 16(*b*).
Figure 16:
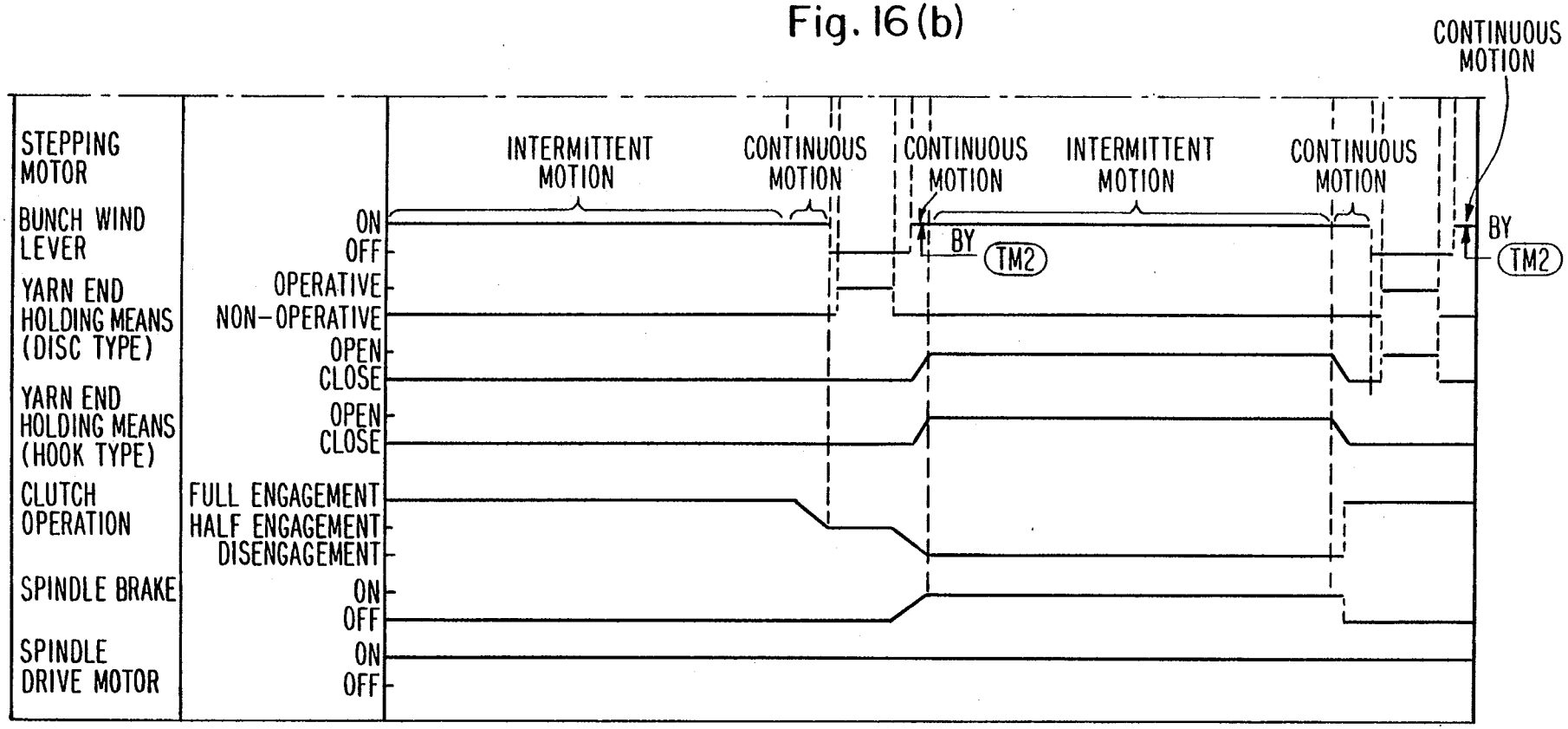

FIG. 16 is a time chart illustrating an operative sequence of the respective elements in a winder with a bunch winding device according to the present invention.

All of the embodiments stated above relate to a turret type winder in which a working bobbin is distanced from a yarn traverse device as the bobbin diameter increases in accordance with the progress of a winding operation. The present invention, however, is not limited to this type of winder and, can be applied to other types of winders in which a working bobbin takes up a yarn at a fixed position while the yarn traverse device moves away therefrom, as disclosed, for example, in Japanese Examined Patent Publication No. 60-39625, and Examined Utility Model Publication Nos. 61-3895 and 1-17564.

According to the present invention, a yarn traverse cam is axially shifted momentarily to a basic end of a bobbin by a predetermined distance, whereby a yarn is displaced out of a normal traverse range to the basic end of the bobbin and caught by a yarn holding means provided on a bobbin chuck, which yarn is severed between the yarn holding means and a full bobbin now braked by a clutch mechanism with a brake. That is, a yarn transfer operation can be smoothly carried out without using an exclusive yarn transfer guide.

At the respective stages in the course of the orbital motion of the bobbin chuck, a spindle carrying a full bobbin is stepwisely braked to decrease the rotational speed thereof, by a torque-adjustable clutch/brake mechanism so that the rotational speed of a common motor driving both spindles is increased more than once in the normal winding operation. Thereby, a yarn slack due to the lowering of a winding speed of a spindle carrying an empty bobbin, which is liable to occur during the yarn transfer from the full bobbin to the empty bobbin, can be eliminated. In addition, since a cam provided along a path of the orbital motion of a turret disc is used as means for automatically actuating this clutch mechanism during the orbital motion of the spindle/-bobbin chuck, the structure thereof can be simplified.

Further, since the speed of an orbital motion is stepwisely varied as "intermittent", "continuous" and "stationary" in accordance with the respective phases of the orbital motion, an effective winding operation can be performed.

INDUSTRIAL APPLICABILITY

The present invention is suitably applicable to a production or take-up process for a ceramics fiber or a carbon fiber, a sizing process for a tire cord, or a rewinding process for dividing a large yarn package into a plurality of small size yarn packages.

We claim:

1. A turret type yarn winder for carrying out a continuous yarn-winding operation, comprising:

a) a frame;

b) a turret disc rotatably supported on said frame;

c) first driving means for rotatably driving said turret disc about its axis;

d) a pair of spindles supported on said frame and extending through said turret disc;

e) second driving means for rotatably driving said spindles about their respective axes by imparting a torque transmission thereto, wherein said spindles are rotatably driven along with the turret disc with the first driving means, and wherein said spindles are rotatably driven about their own respective axes with the second driving means;

f) a pair of bobbin chucks, each said bobbin chuck being carried by a respective spindle for rotation therewith:

g) said bobbin chucks being carried by said spindles at diametrically symmetrical positions on said turret disc symmetrically with each other relative to a center of said turret disc for rotation therewith, each said chuck being adapted to carry a bobbin thereon such that each said chuck and associated bobbin can be selectively moved from a winding-start position, through a full-bobbin position, a doffing-start position where said full bobbin is replaced by an empty bobbin, a doffing-end position, a yarn-transfer position, and returning to said winding-start position;

i) mechanical clutch means for independently regulating the torque transmission imparted from the second driving means to at least one of said spindles;

j) actuating means for actuating the clutch mechanism in relation to the position of the bobbin as said bobbin is rotated along with the turret disc, whereby the torque transmission from said second driving means to a respective spindle in the full bobbin position is effectively decreased in relation to the torque transmission from the second driving means to a respective said spindle in said winding-start position.

2. A winder as defined by claim 1, wherein the clutch means comprises a clutch member which is slidably carried on a respective spindle for rotation therewith, and switching means for selectively switching the clutch member between any one of three conditions including a full engagement condition in which a torque from the second driving means is fully transmitted to said respective spindle, a half engagement condition in which part of the torque from the second driving means is transmitted to said respective spindle and a non-engagement condition in which no torque from the second driving means is transmitted to said respective spindle.

3. A winder as defined by claim 2, wherein the clutch member is maintained in the full engagement condition when the turret disc is rotated between the winding-start position and the full bobbin position, wherein the clutch member is maintained in the half engagement condition when the turret disc is rotated between the full bobbin position and the doffing-start position, wherein the clutch member is maintained in the non-engagement condition when the turret disc is rotated between the doffing-start position and the doffing-end position, and wherein the clutch member then again returns to the full engagement condition thereafter.

4. A winder as defined by any one of claims 1, 2 and 3, wherein the rotation of at least one of said bobbin chucks is interrupted at the yarn-transfer position.

5. A winder as defined by any one of claims 1, 2 and 3, wherein the first driving means comprises a stepping motor and the second driving means comprises one of a torque motor and a speed-variable motor.

6. A winder as defined by any one of claims 1, 2 and 3, wherein the turret disc is rotatably driven by the intermittent rotation of the first driving means, from the doffing-start position to the doffing-end position, then by the continuous rotation of the first driving means, from the doffing-end position to the yarn-transfer position, and wherein said turret disc then stops at the yarn-transfer position for a predetermined period, and wherein by the continuous rotation of said first driving means said turret disk is rotated to the winding-start position.

* * * * *